US006571882B2

(12) United States Patent
Yen

(10) Patent No.: US 6,571,882 B2
(45) Date of Patent: Jun. 3, 2003

(54) FIRE FIGHTING VEHICLE AND EQUIPMENT

(76) Inventor: Ping-Li Yen, 185 W. Norman Ave., Arcadia, CA (US) 91007

( * ) Notice: Subject to any disclaimer, the term of this patent is extended or adjusted under 35 U.S.C. 154(b) by 0 days.

(21) Appl. No.: 09/768,774

(22) Filed: Jan. 25, 2001

(65) Prior Publication Data

US 2002/0096339 A1 Jul. 25, 2002

(51) Int. Cl.[7] ..... A62C 27/00; A62C 35/02; A62C 2/00

(52) U.S. Cl. ..... 169/24; 169/25; 169/26; 169/27; 169/46; 169/44; 169/45

(58) Field of Search ..... 169/24, 44, 25, 169/85, 26, 62, 27, 30, 33, 46, 47, 52; 239/172, 148, 146, 176, 197, 195, 162

(56) References Cited

U.S. PATENT DOCUMENTS 3,463,233 A 8/1969 Haessler
3,762,478 A * 10/1973 Cummins ..... 169/24
3,866,687 A 2/1975 Banner
4,356,870 A 11/1982 Gaylord et al.
4,593,855 A * 6/1986 Forsyth ..... 239/74
4,981,178 A * 1/1991 Bundy ..... 169/9
5,086,846 A * 2/1992 Carlson ..... 169/15
5,313,548 A * 5/1994 Arvidson et al. ..... 388/800
6,006,841 A * 12/1999 Hunke ..... 169/24
6,029,750 A * 2/2000 Carrier ..... 169/52

* cited by examiner

*Primary Examiner*—Michael Mar
*Assistant Examiner*—Davis Hwu
(74) *Attorney, Agent, or Firm*—William W. Haefliger

(57) ABSTRACT

A fire fighting unit to be installed and transported on a relatively small vehicle, comprising, in combination, frame structure sized for installation on a vehicle; fluid supply apparatus carried on the frame structure; and including a water supply tank, a fire fighting foam tank, a compressed gas source, fluid delivery lines from the tanks, and controls including pumps carried on the frame structure, for controlling fluid delivery via the lines, and in mixed condition to at least one fluid delivery nozzle.

34 Claims, 9 Drawing Sheets

FIRE FIGHTING VEHICLE AND EQUIPMENT

BACKGROUND OF THE INVENTION

This invention relates generally to fire fighting, and more particularly to use of fire fighting vehicles, in relatively inaccessible areas.

Many areas such as in crowded urban zones are relatively inaccessible to modern fire fighting vehicles, which are generally of large size. Such inaccessible zones include narrow streets and alleys, between buildings and homes, wildlands and forest fire areas. There is need for vehicles and vehicle transported equipment that is capable of accessing such inaccessible zones, and of successfully fighting fires in such zones.

SUMMARY OF THE INVENTION

It is a major object of the invention to provide fire fighting methods and apparatus meeting the above needs, as well as other needs, as will appear. Basically, the invention provides a fire fighting unit to be installed and transported on a relatively small vehicle, comprising, in combination:

a) frame structure sized for installation on the vehicle, b) fluid supply means carried on the frame structure, and including i) a water supply tank, ii) a fire fighting foam tank, iii) a compressed gas source, c) fluid delivery lines from the tanks, and controls including pumps carried on the frame structure, for controlling fluid delivery via lines, and in mixed condition to at least one fluid delivery nozzle.

As will be seen, the small size vehicle typically includes one of the following i) a relatively small sized fire truck, ii) an all terrain vehicle, iii) a relatively small sized truck, and wherein at least one of the nozzles is carried by the vehicle, in spaced relation to the frame structure.

Another object includes provision of at least one nozzle carried in series with a fluid delivery hose, the hose carried by said frame structure. As will be seen, a fluid delivery hose may be on a hose reel carried by the installed frame structure. The latter may include a first frame structure carrying the fluid supply tanks, and a second frame structure carrying the controls and including pumps.

A further object is to provide such controls to have manually operable control elements exposed at the exterior of said frame structure. The controls may have manually operable control elements exposed at an end of the second frame structure which is spaced from the first frame structure. Further, the vehicle may have forward and rearward ends, the exposed control elements located at the rearward end of the vehicle. Accordingly, the operator need not stand at the side of the vehicle, which may be relatively maneuverable as in a narrow alley way, but he is enabled to operate the controls at the open rear of the vehicle. The controls may include a fluid mixing zone to which the fluid delivery lines from the truck extend; and also valves in the lines extending from the tanks.

The method of operation typically includes i) maneuvering the relatively small vehicle into a relatively inaccessible area where a fire exists; and ii) operating the controls at the vehicle end to deliver a mixture of water, foam and compressed air to the nozzle.

The method may also include supporting the nozzle on top of the vehicle, to be freely accessible for maneuver, in narrow driveways and zones.

Yet another object is to provide multiple small size fire fighting vehicles to be maneuvered close to a fire or fire front, the vehicle having length between about 6 and 10 feet, and narrow width, and further characterized by at least one nozzle carried on the vehicle, at least one tank carried by the vehicle to supply fire abating pressurized fluid including pressurized foam to the nozzle, said at least one tank located at a relatively low level on the vehicle, Means may be provided on the small vehicle to control pressurized fluid (including fire suppression foam) delivery from the nozzle or nozzles on the vehicle, and to have one of the following forms:

i) a spray in cone form ii) mist droplets iii) a narrow stream of fluid.

The method of fire fighting employing self-propelled small vehicles as referred to includes:

propelling and maneuvering said relatively small vehicle across terrain to an area where a fire exists, delivering fluid from said tank to said nozzle, in pressurized condition, and maneuvering said nozzle to direct fluid into the fire.

The above method may include providing a fluid source or sources at a selected distance from the fire, and returning said vehicles to said source or sources fro replenishing fluid into the vehicle tanks, as needed, for subsequent use of the vehicle in fighting the fire. The fluid source may advantageously include a tank or tanks or a carrier or transport vehicle configured to carry certain of the fire-fighting vehicles, to be off-loaded in the vicinity of a fire; whereby close access to a fire front can be made available, in rough terrain zones, with fire-fighting fluid delivery being provided from small highly maneuverable vehicles, which can quickly retreat from rapidly spreading fire zones, if needed. The small vehicles can carry tools, saws, hoses and nozzles, gurneys for evacuating injured humans, and can be radio controlled, and positioned by or from a control center, as for example another vehicle, or by satellite if needed.

These and other objects and advantages of the invention, as well as the details of an illustrative embodiment, will be more fully understood from the following specification and drawings, in which:

DRAWING DESCRIPTION

FIGS. 12–14 are plan views of various types of fire fighting small vehicles, as referred to.

DETAILED DESCRIPTION

Figure 4:
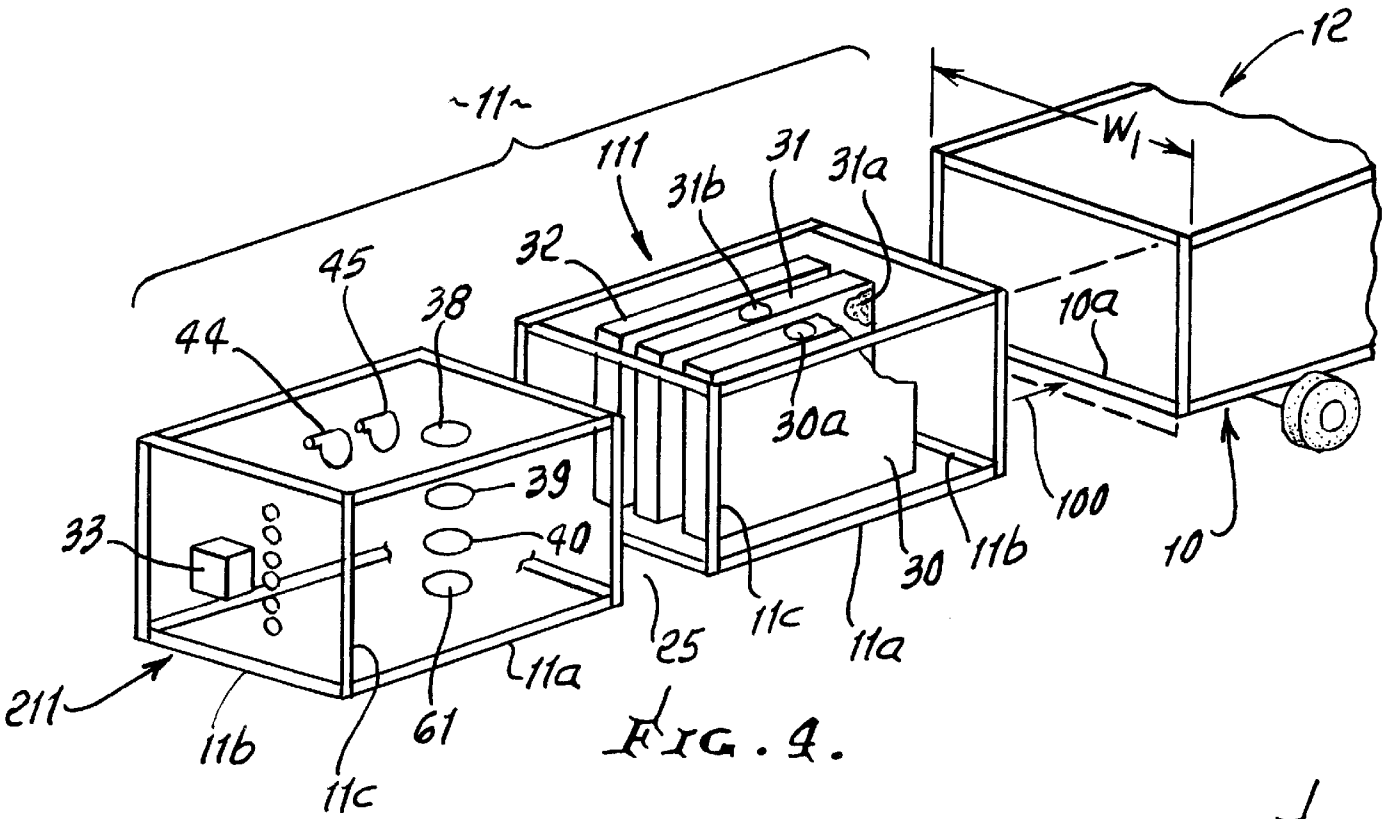
FIG. 4 is a perspective view of a modular unit, including a frame, before its installation on the FIG. 1 vehicle.
Figure 6:
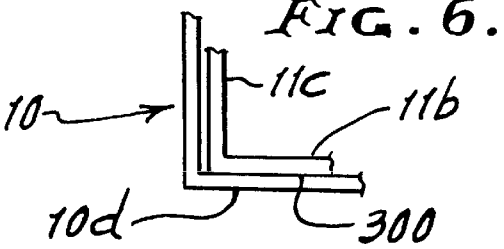
FIG. 6 shows slide-in installation of a frame onto a vehicle bed.
Figure 5:
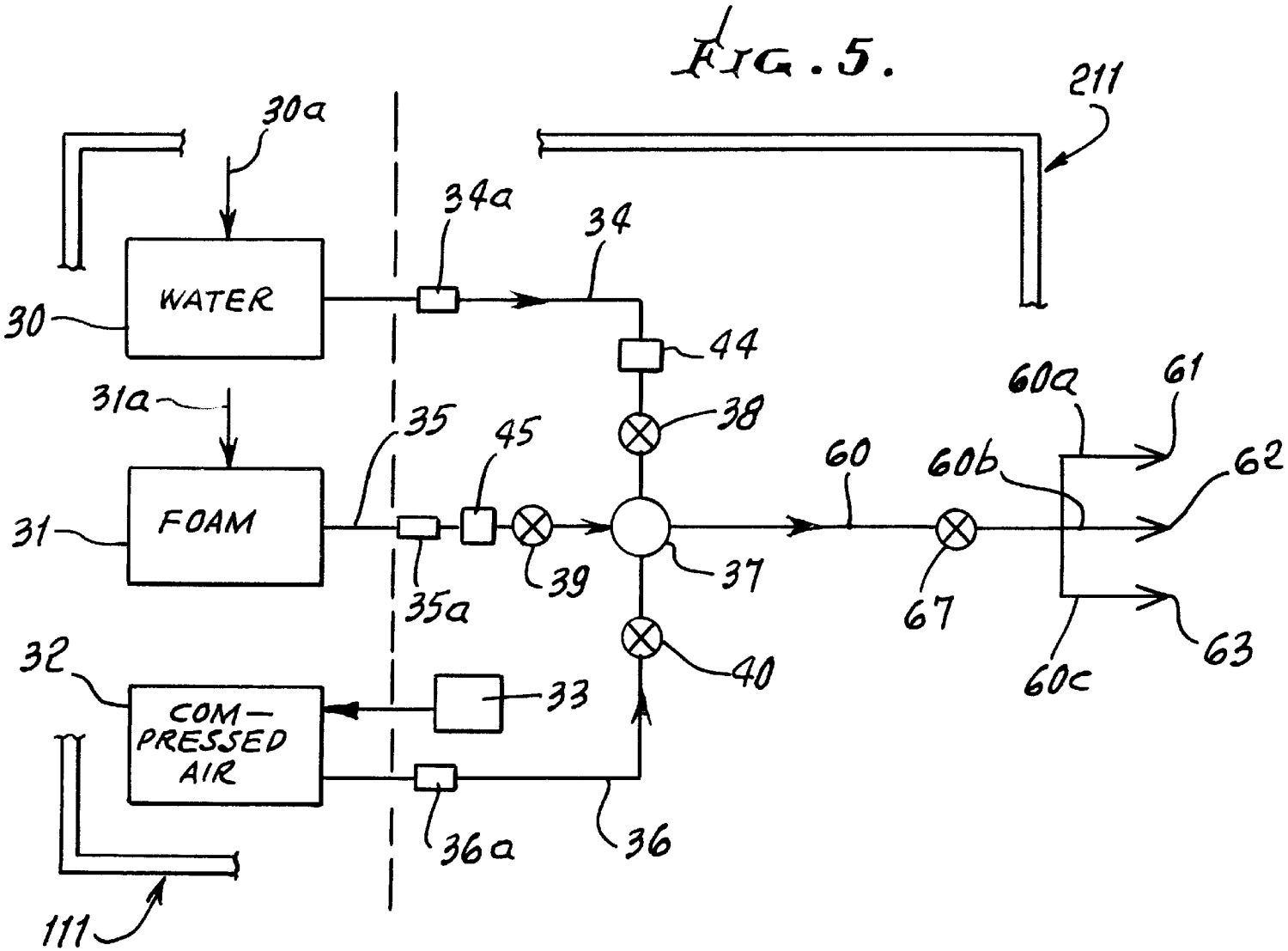
FIG. 5 is a schematic diagram of a fire fighting fluid supply system, as incorporated in the FIG. 4 unit.

Referring first to FIGS. 4 and 5, the support enclosure 10 of a relatively small fire fighting vehicle is adapted to receive the frame structure 11 of a fire fighting unit 12. The frame structure may be modular, and is shown as a box configuration or configurations, with longitudinal supports 11*a*, lateral supports 11*b*, and vertical supports 11*c*. These are typically configured to allow simple and rapid endwise slide-in installation of the unit, into the support enclosure 10, in direction 100. See FIG. 6 showing sliding at 300 of supports 11*c* and 11*a* on enclosure bed 10*d*.

Figure 1:
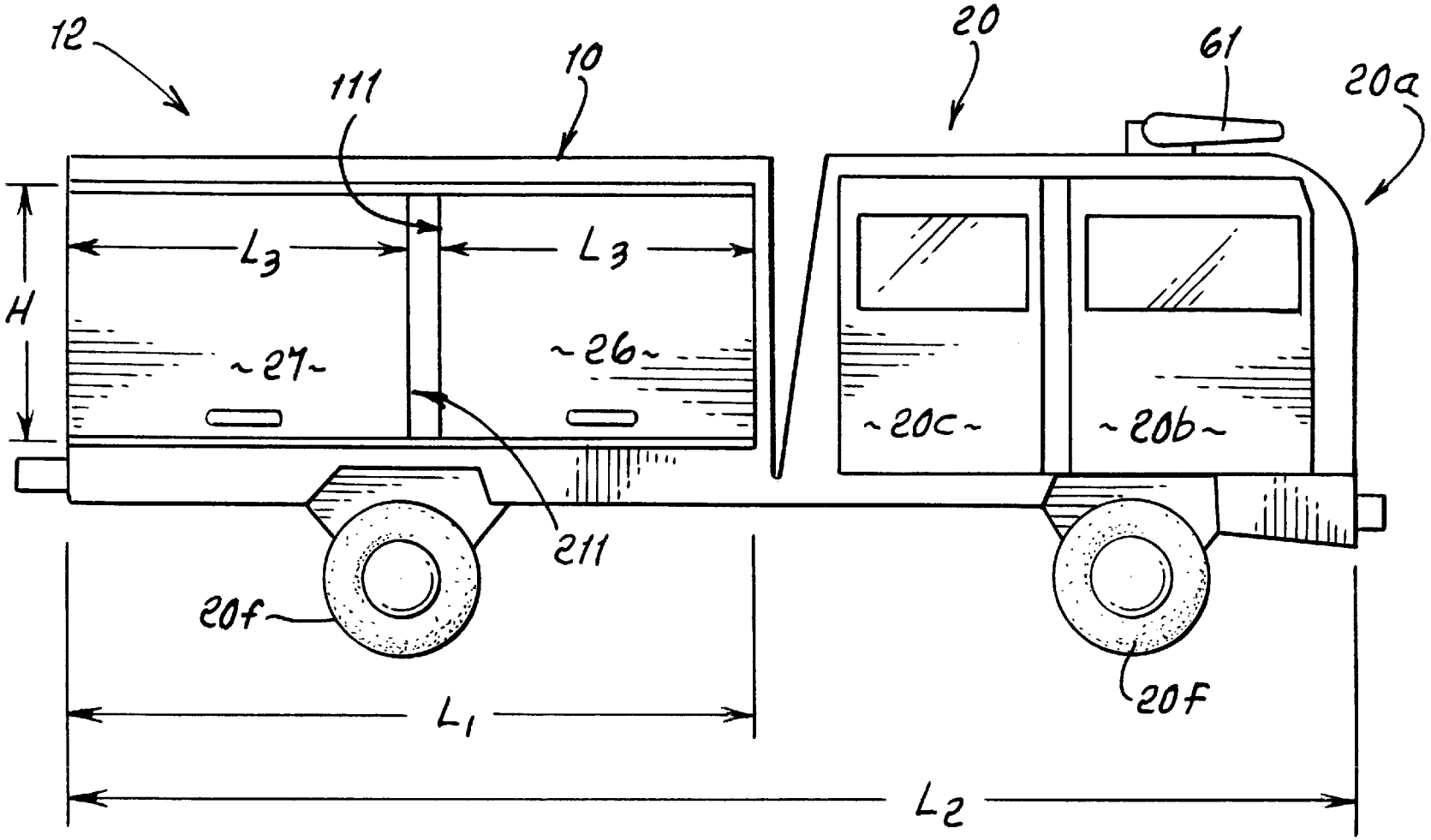
FIG. 1 is a right side view of a fire fighting vehicle on which equipment in accordance with the invention is installed.
Figure 2:
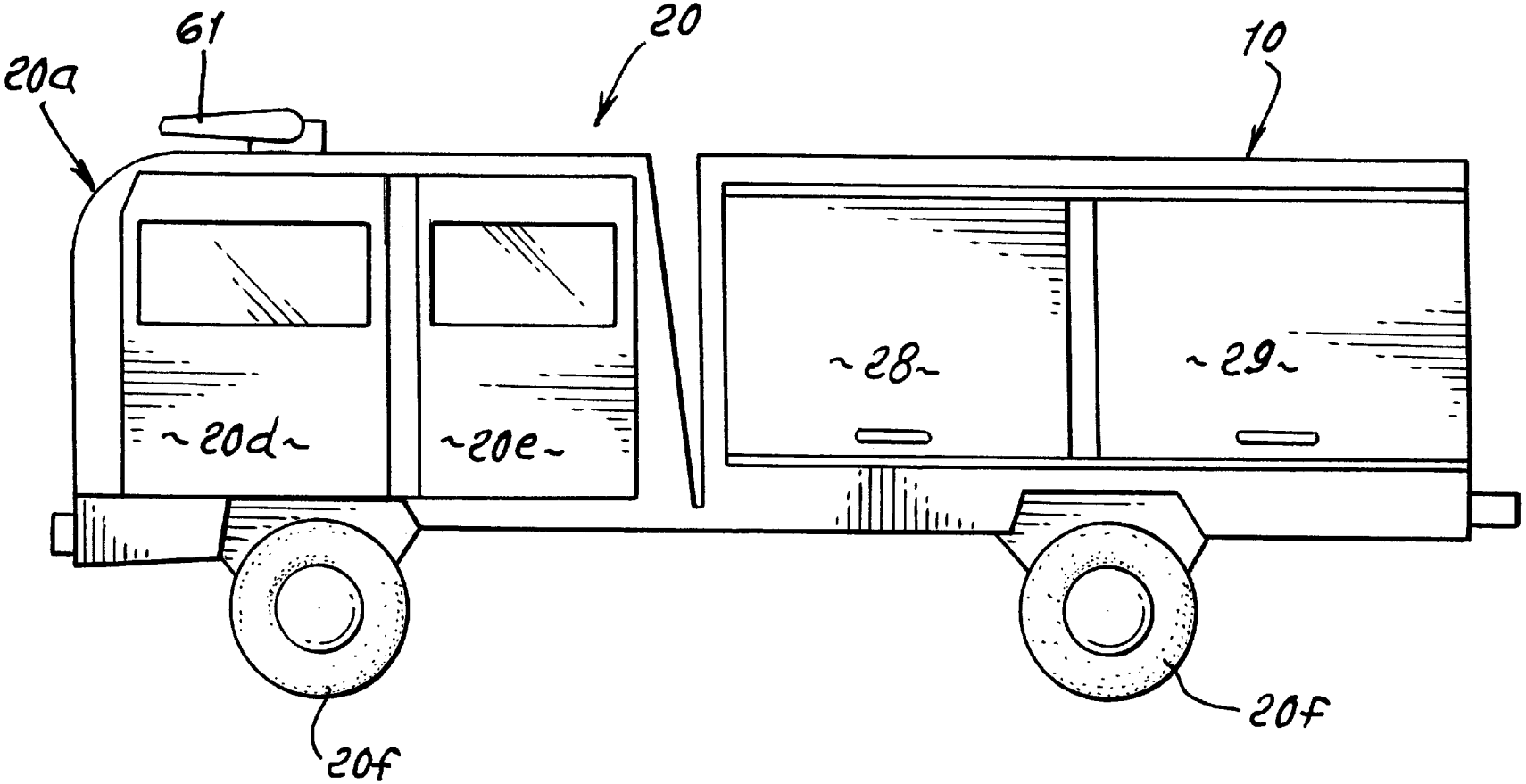
FIG. 2 is a left side view of the FIG. 1 vehicle.
Figure 3:
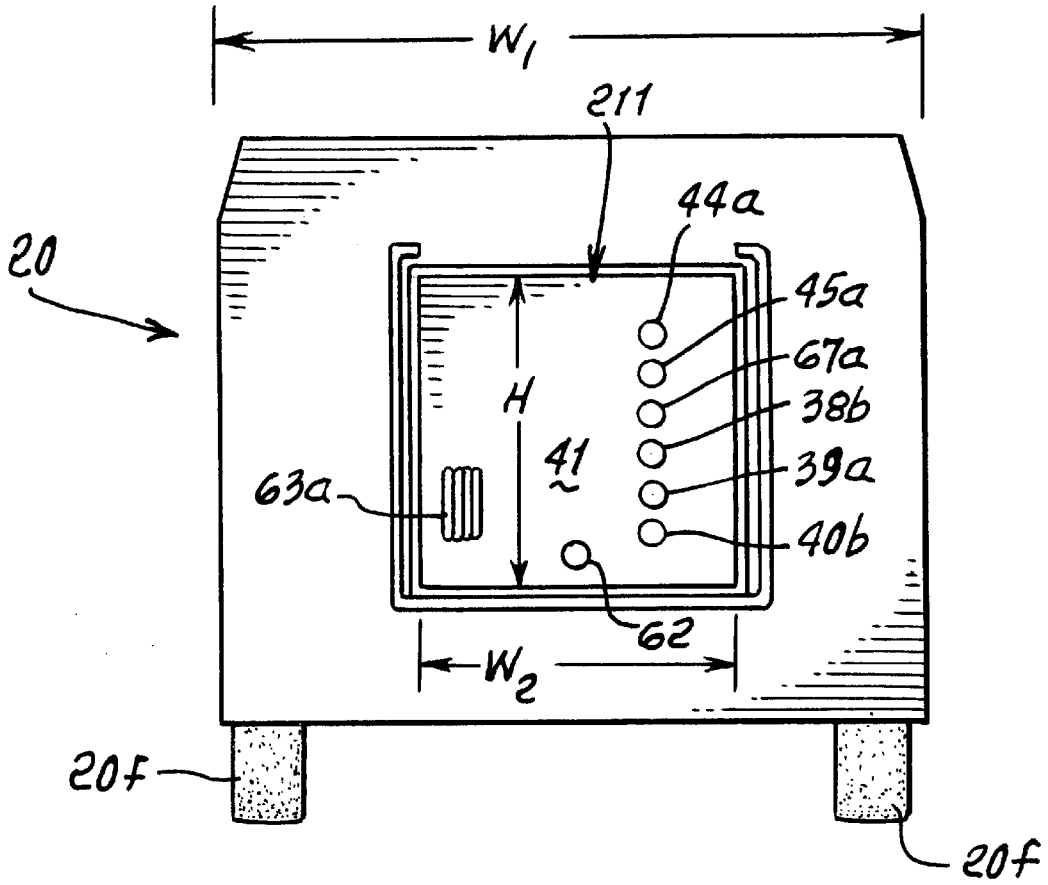
FIG. 3 is a rear view of the FIG. 1 vehicle, above the level of vehicle wheels.

The enclosure is part of fire fighting transport vehicle, typically of relatively small size, enabling its travel access into narrow zones, as for example alleys, and various roadways, or in crowded areas with other vehicles and people, for fighting fires which otherwise may not be accessible. One such vehicle is shown at 20 in FIGS. 1–3, and will be further described. The overall length $L_1$, of the enclosure 10 is about 126 inches or smaller; and the overall length $L_2$ of the vehicle 20 is about 230 inches or smaller. The overall width $W_1$ of the vehicle is about 85 inches or smaller.

In the example, the frame structure 11 is in two sections 111 and 211, each separately installable lengthwise into the support enclosure 10, with spacing 25 between the installed sections 111 and 211. The overall length $L_3$ of each section 111 or 211 is about 60 inches or smaller, and the overall width $W_2$ of each section is about 48 inches or smaller. The overall height H of each section may also be about 48 inches or smaller. These dimensions enable unusually efficient handling, installation, and removal of the sections into and from the enclosure 10; and they also enable efficient access to the equipment carried by the section, as via sliding doors 26–29 at opposite sides of the enclosure 10, for inspection and repair. Vehicle 20 has a forward cab 20*a*, side doors 20*b*–20*e*, and wheels 20*f*. One such vehicle is produced by IZUSU, Japan, and with a total weight of less than 10 tons. Other types of small motorized transport vehicles are usable, as for example all terrain vehicles (ATVs).

Referring again to FIGS. 4 and 5, section 111 of the frame structure carries three tanks 30, 31 and 32. Tank 30 contains water, and may be filled via top inlet 30*a*. Tank 31 contains fire resistant foam 31*a*, and to be filled via top inlet 31*b*. Foam 31*a* may for example consist of ammonium phosphate. Tank 32 is a source of compressed gas, as for example air; and a supply air compressor is shown at 33, and carried in the frame structure 211, separated from structure 111 and the tanks supported therein, as for safety reasons.

FIG. 5 shows water, foam and compressed air delivery lines 34, 35 and 36 from the three tanks, and extending to mixer junction 37, carried on the frame section 211. Control valves 38–40 are or may be installed in the three lines, as shown, and controls for the three valves are indicated at 38*b*, 39*a* and 40*b* on the rear panel 41, at the exposed rear of the frame structure 211. Valve 39 may be a suitable foam proportioner valve. Pumps may be installed in series with lines 34 and 35, ahead of the valves in those lines. Such pumps (and associated motors) are indicated at 44 and 45, and may be controlled as to speed, as via pump motor controls 44*a* and 45*a* at rear panel 41. Line 34–36 series connector may be provided, and are indicated at 34*a*–36*a*.

The combined or individual fluids (compressed air, water and foam, proportioned as controlled) are delivered at line 60 seen in FIG. 5, leading to a nozzle or nozzles, as for example via line sub-sections 60*a*–60*c*. Such sections extend to a nozzle 61 at the top or front bumper of the truck; a nozzle 62 at the rear of the truck connected to the end of a hose; and to a nozzle 63 at the end of a hose reel 63*a* located at the rear of the frame structure 211. Accordingly, the user may mount the cab to use and direct nozzle 61, within the narrow width confines of the vehicle, without interference with walls, people or other vehicles at the side of the cab; or, the user may position himself at the rear of the frame structure to use nozzles 62 and 63, within the narrow confines of the vehicle. Suitable fluid delivery valves may be located at the nozzles. FIG. 5 also shows a master control valve 67 in line 60, with a control at 67*a* at the rear of the frame structure.

The method of use of the fire fighting structure includes maneuvering the relatively small vehicle into a relatively inaccessible area where a fire exists; and operating the controls at section 211 to deliver a mixture of water, foam and compressed air to a maneuverable nozzle or nozzles; and maneuvering that nozzle or nozzles to direct fluid from the nozzle into the fire in the inaccessible area.

The method may also be considered to include installing the modular frame sections with carried equipment as described, onto a vehicle, as described, for transport, use, and control of fluid delivery from the nozzle or nozzles.

Fluid mist may be produced by the nozzle or nozzles, if of mist producing type or construction. Mist droplets less than 1,000 Å in diameter are found to be especially useful and effective.

Nozzle 61 is shown on top of the vehicle, for ready maneuverability, within the narrow lateral confines of the vehicle.

Figure 7:
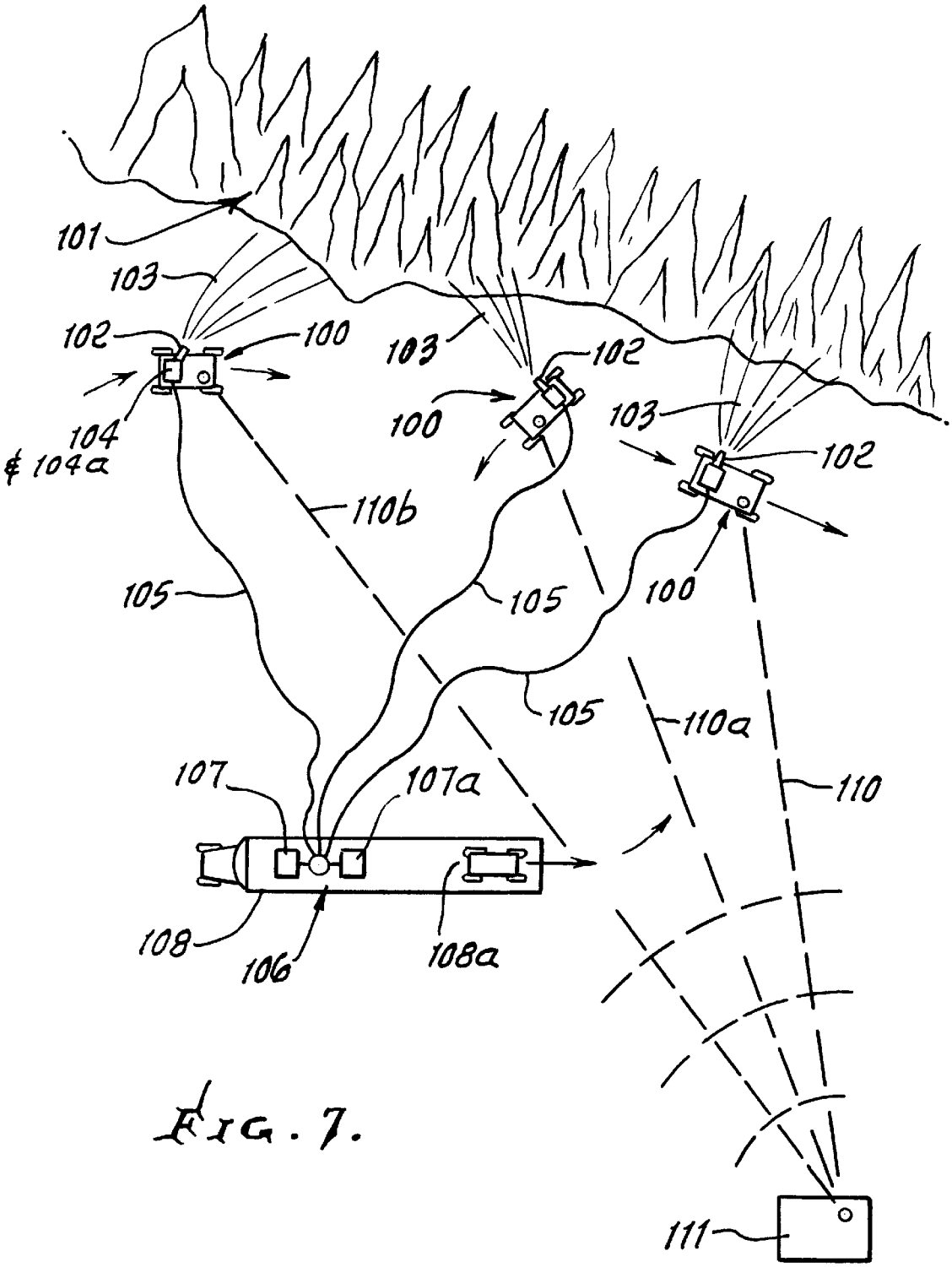
FIG. 7 is a plan view of a number of small size fire fighting vehicles maneuvering close to a fire front, and supplied with pressurized fluid from a source vehicle.

Referring to FIG. 7, it shows multiple fire fighting, small, self propelled vehicles 100 maneuvered or maneuvering into close-in relation to a fire front 101 such as a forest fire. The vehicles carry nozzles 102 for spraying pressurized fluid at 103 onto the fire, and said fluid may typically consist of water and fire suppressing foam, as referred to above. The vehicles may contain supply or storage tanks 104 for the fluid or fluids, to be mixed and pumped to the nozzles under pressure, as will be discussed with reference to FIG. 8. Hoses 105 may be provided to replenish the vehicle tanks with fluid or fluids, as from a source or sources 106. The latter may include large tanks 107 and 107*a* on a carrier or transport self-propelled vehicle 108, and the small vehicles 100 may be rapidly transported by the large vehicle (as on its elongated bed 108*a*), to the fire zone. All the vehicles 100 and 108 are adapted to maneuver on rough terrain. In addition, the vehicles 100 and 108 may be controlled as by radio links 110, 110*a* and 110*b*, from a control center 111, for best and most efficient positioning to fight the fire 101. Command center 111 may be located on the ground, or in an aircraft, or on a satellite, from which the fire front area and the vehicle may be carefully observed. Firemen may be employed to drive the vehicles close in to the fire front, and to deploy or aim the spray nozzles 102, to best effect for fire abatement; and in case of extreme danger, the self-propelled vehicles 100 can be rapidly driven away from the advancing fire, i.e. much faster than a fire fighting individual can run, for safety.

Figure 8:
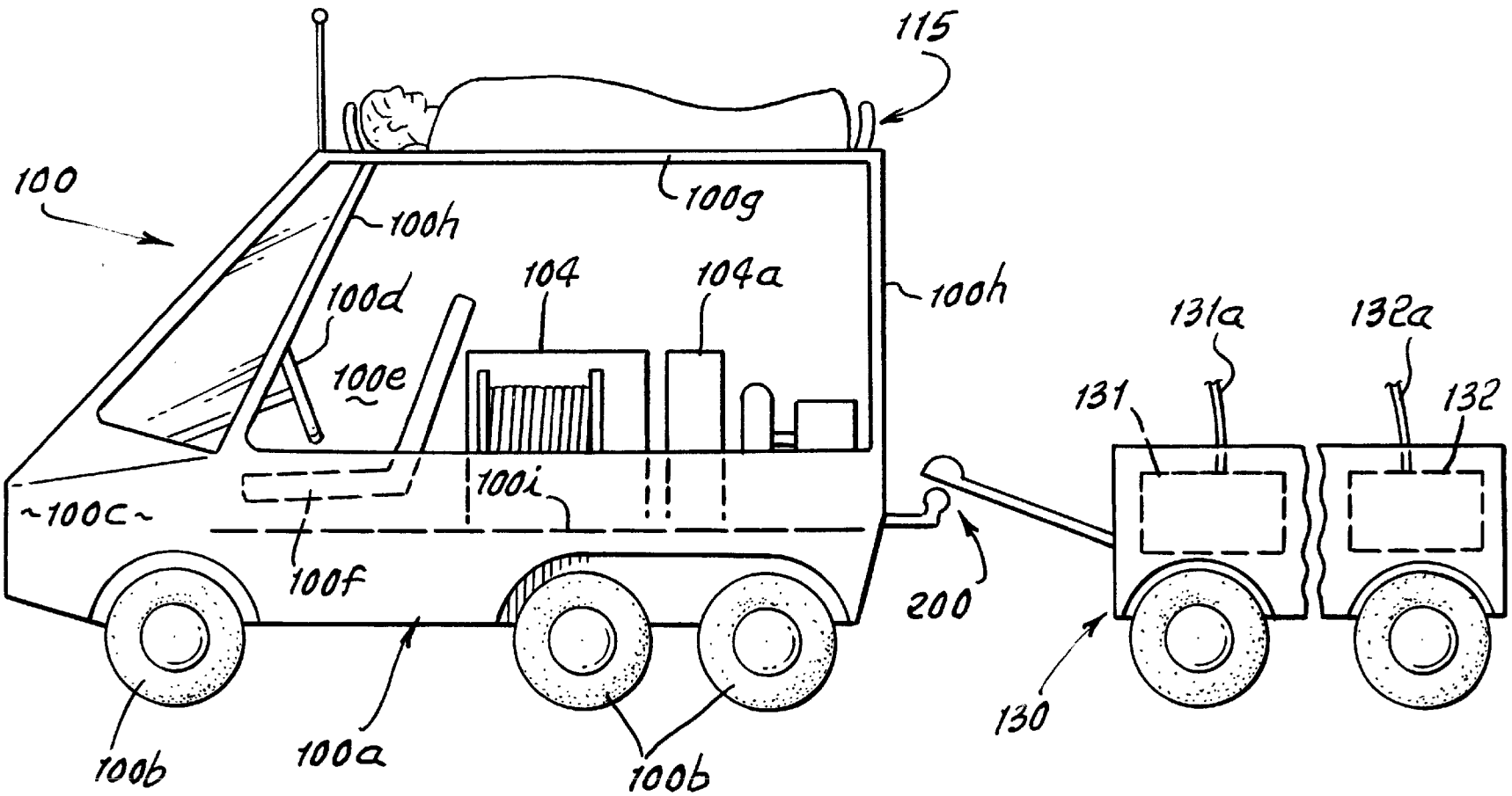
FIG. 8 is a side elevation showing a small sized fire fighting vehicle, as shown in FIG. 7.

FIG. 8 shows one form of representative or preferred vehicle 100, having a chassis 100*a*, wheels 100*b*, engine area 100*c*, steering wheel 100*d*, driver compartment 100*e*, seat 100*f*, roof 100*q*, support struts 100*h*, and rear deck 100*i*. A gurney 115 is supported on roof 100*g*, for transport of an injured fire-fighter to safety.

Figure 9:
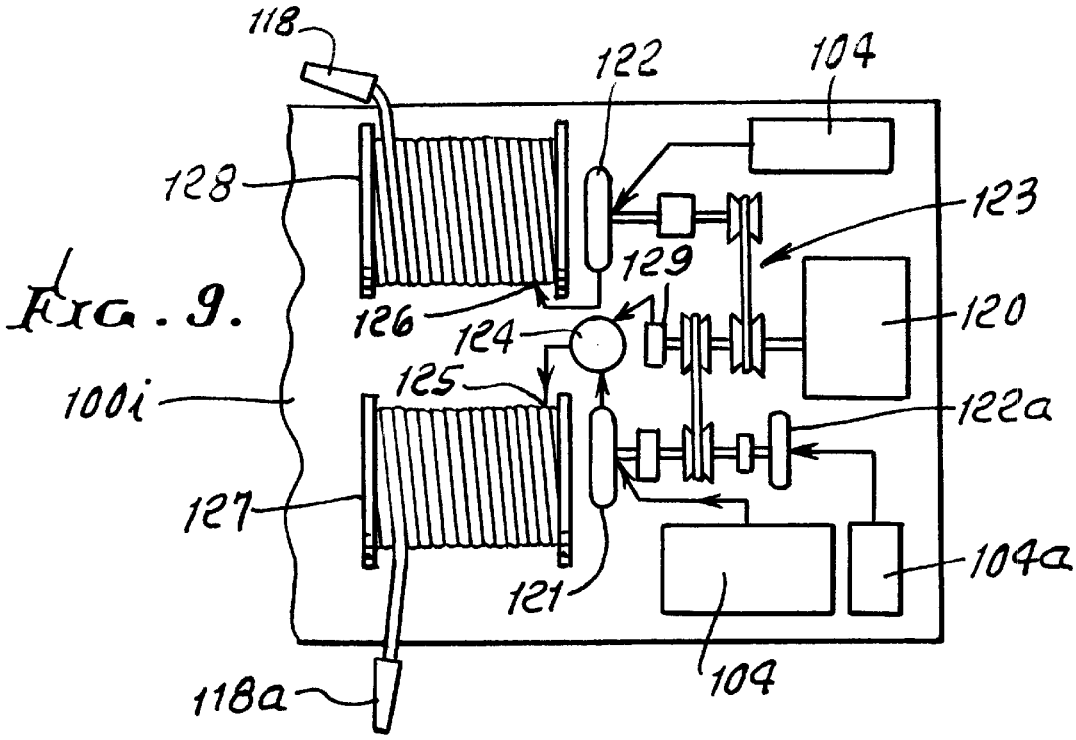
FIG. 9 is a plan view of the rear interior of a small size fire fighting vehicle.

Located on lower level deck 100*i* is a tank 104, or tanks 104 and 104*a*. See also FIG. 9. Tank 104 contains water, and tank 104*a* contains fluid foam or liquid that produces fire suppressing foam when mixed with water and sprayed toward the fire. Such spray can form a divergent cone, or a narrow stream, as controlled by an adjustable spray nozzle 118. FIG. 9 also shows an auxiliary engine 120 or power take-off drive or shaft drive, pumps 121,122 and 122*a*, and drives 123 to the pumps. The mixer 124 receives fluid from tanks 104 and 104*a*, and from air compressor 129. Fluid flows from the mixer 124, to hose 125 and on reel 127. Fluid also flows from 104 via 122 to hose 126 on reel 128. The hoses terminate at nozzles 118 and 118*a*, either or both of which can be positioned, oriented, and adjusted to spray pressurized liquid in water mist form, or compressed air driven foam, for fire abatement. The nozzles are independently activated, i.e. usable.

In FIG. 8, a towed wheeled vehicle 130 carries an auxiliary tank or tanks 131 and 132 for water or foam liquid, to which the pumps can be connected by hoses 131*a* and 132*a*, if needed. A tow hitch appears at 200.

Figure 10:
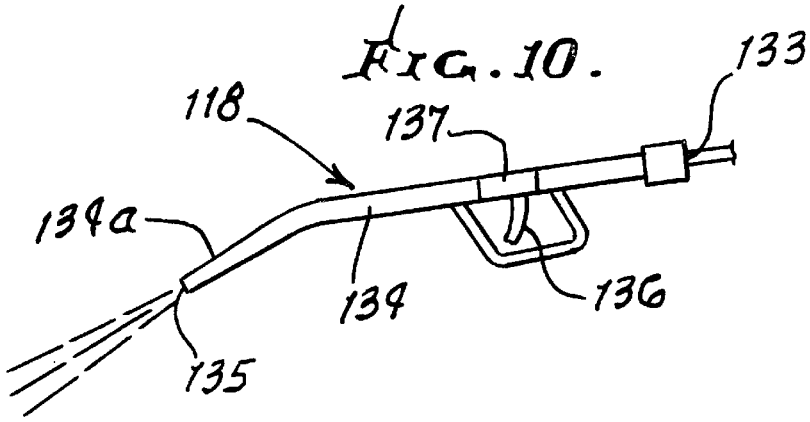
FIGS. 10 and 11 are elevations showing nozzles supplied with pressurized fluid, to be delivered to a fire or fire front.
Figure 11:
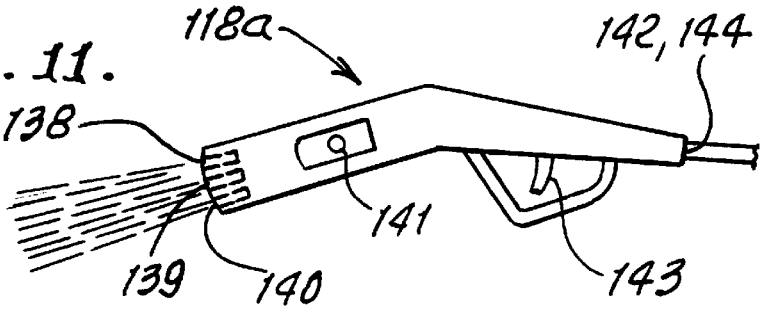

FIG. 10 shows a nozzle 118, having an inlet 133; tubular duct 134, angled at 134*a*; outlet 135; and trigger 136 controlled valve 137. FIG. 11 shows another form of nozzle 118*a* having three outlets 138, 139 and 140 respectively, for water, foam, and other liquid, if desired. An adjustment at 141 enables proportioning control of delivery from the outlets. See also inlets at 142–144 for the two or three liquids, trigger control at 143, for the amount of spray released.

Figure 12:
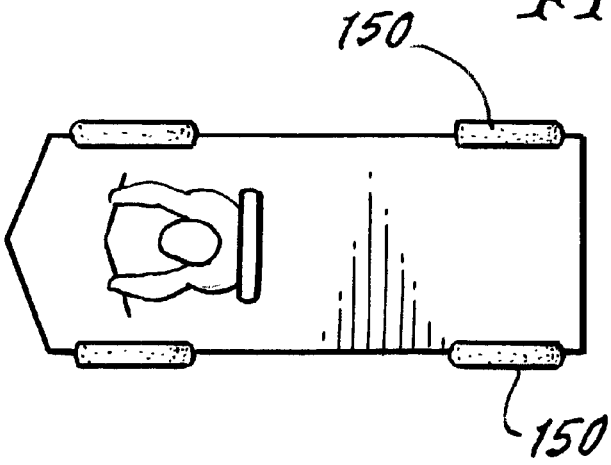
Figure 13:
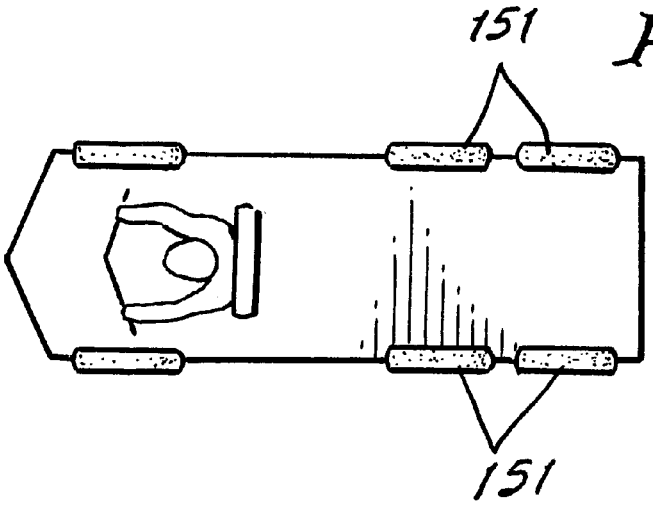
Figure 14:
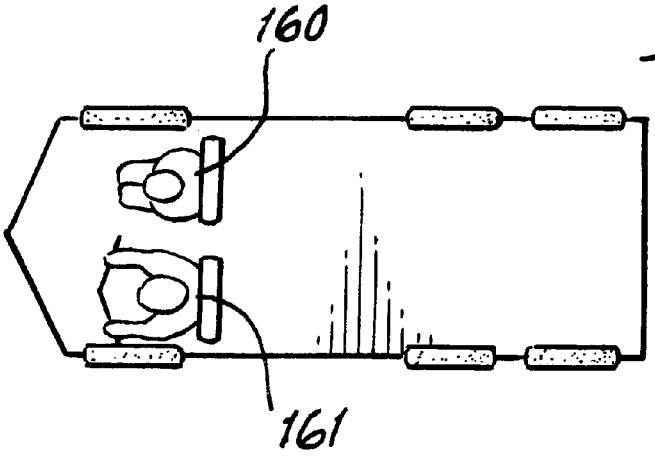

FIGS. 12–14 show three forms of the small vehicle, with single driven wheels 150 in FIG. 12; dual rear drive wheels 151 in FIG. 13; and a widened vehicle, for two passengers 160 and 161 in FIG. 14.

Preferably, the vehicle 10, and those shown in FIGS. 12–14 have length between 6 and 10 feet and width between 3½ and 5 feet, enabling extreme maneuverability in close proximity to fire zones.

I claim:

1. A fire fighting unit to be installed and transported on a relatively small vehicle, comprising, in combination:

a) frame structure sized for installation on said vehicle, b) fluid supply means carried on said frame structure, and including i) a water supply tank, ii) a fire fighting foam tank, iii) a compressed gas source, c) fluid delivery lines from said tanks, and controls including pumps carried on the frame structure, for controlling fluid delivery via said lines, and in mixed or proportioned condition to at least one fluid delivery nozzle, d) said frame structure including a first frame structure carrying said fluid supply tanks, and a second frame structure carrying said controls and including said pumps and valves, e) there being supports for said first and second frame structures allowing independent slide-in, slide-out movement thereof relative to the vehicle.

2. The combination of claim 1 including multiple of said fluid delivery nozzles.

3. The combination of claim 2 including said vehicle which is one of the following:

i) a relatively small sized fire truck, ii) an all terrain vehicle, iii) a relatively small sized truck, and wherein at least one of said nozzles is carried by the vehicle, in spaced relation to the frame structure.

4. The combination of claim 2 wherein at least one nozzle is carried in series with a fluid delivery hose, the hose carried by said frame structure.

5. The combination of claim 4 including a fluid delivery hose on a reel carried by the frame structure.

6. The combination of claim 1 wherein said controls have manually operable control elements exposed exteriorly of said frame structure.

7. The combination of claim 1 wherein said controls have manually operable control elements exposed at an end of said second frame structure which is remote from said first frame structure.

8. The combination of claim 7 including said vehicle having forward and rearward ends, said exposed control elements located at said rearward end of the vehicle.

9. The combination of claim 1 wherein said controls include a fluid mixing zone to which fluid delivery lines from the tanks extend.

10. The combination of claim 9 wherein said controls include control valves in said lines extending from said tanks.

11. The method of fire fighting employing a fire fighting unit installed for transport on a relatively small self-propelled vehicle, and comprising a) frame structure sized for installation on said vehicle, b) fluid supply means carried on said frame structure, and including i) a water supply tank, ii) a fire fighting foam tank, iii) a compressed gas source, c) fluid delivery lines from said tanks, and controls including pumps carried on said frame structure, for controlling fluid delivery via said lines, and in mixed condition to at least one fluid delivery nozzle, said method including:

d) said frame structure provided to include a first frame structure carrying said fluid supply tanks, and a second frame structure carrying said controls and including said pumps and valves, e) there being supports provided for said first and second frame structures allowing independent slide-in, slide-out movement thereof relative to the vehicle, f) maneuvering said relatively small vehicle into a relatively inaccessible area where a fire exists, g) operating said controls to deliver fluid to said nozzle, h) and maneuvering said nozzle to direct fluid from the nozzle into the fire in said area, i) and independently sliding said first and second frame structures outwardly of the vehicle for inspection or repair of said tanks and controls.

12. The method of claim 11 including providing said nozzle mounted on top of the vehicle.

13. The method of claim 11 including providing said nozzle at the end of a hose carried by said unit.

14. The method of claim 11 including providing said frame structure to include a first frame structure carrying said fluid supply tanks, and a second frame structure carrying said controls and including said pumps.

15. The method of claim 14 including providing said controls to have manually operable control elements exposed exteriorly of said frame structure.

16. The method of claim 15 wherein said vehicle has forward and rearward ends, said exposed control elements located at the rearward end of the vehicle.

17. The method of claim 11 wherein said vehicle is one of the following:

i) a relatively small sized fire truck, ii) an all terrain vehicle, iii) a relatively small sized truck, and wherein at least one of said nozzles is provided on the vehicle in spaced relation to the frame structure.

18. The method of claim 11 including slidably assembling said frame structure onto said vehicle, for transport and use in fire fighting.

19. The method of claim 11 including producing fluid mist at said nozzle, the mist including particles of size less than 1,000 Angstroms.

20. The method of claim 11 including maintaining and operating the nozzle or nozzles within the narrow width confines of the vehicle, less than about 85 inches.

21. In a relatively small, self-propelled, fire fighting vehicle, the combination comprising a) said vehicle having overall length between 6 feet and 10 feet, b) said vehicle having overall with between 3½ feet and 5 feet, c) at least one nozzle carried on the vehicle, d) at least one tank carried by the vehicle to supply fire abating pressurized fluid including pressurized foam to the nozzle, said at least one tank located at a relatively low level on the vehicle, e) means carried by the vehicle for pressurizing said fluid, whereby said fluid can be delivered by the nozzle to fire, f) there being a first frame structure carrying said at least one tank and a second frame structure carrying controls for operating said means, g) there also being supports for said first and second frame structures allowing independent slide-in, slide-out movement thereof relative to the vehicle.

22. The combination of claim 21 including flexible hose carried by the vehicle, said hose connected to deliver said pressurized fluid to the nozzle.

23. The combination of claim 22 including a reel on the vehicle carrying the hose in reeled condition.

24. The combination of claim 22 wherein said means to pressurize said fluid include a pump and auxiliary engine driving the pump.

25. The combination of claim 21 including means for controlling the form of fluid delivered from the nozzle, said fluid being one of the following:

i) a s pray in cone form ii) mist droplets iii) a narrow stream of fluid.

26. The combination of claim 21 wherein said fluid in the tank or tanks is one of the following:

i) water, ii) fire fighting foam, iii) compressed gas to pressurize said fluid, iv) water in one tank and fire fighting foam in another tank, v) water in one tank, fire resistant foam in another tank, and compressed gas to pressurize said water and foam.

27. The method of fire fighting employing a relatively small, self-propelled fire fighting vehicle comprising a) said vehicle having overall length between 6 feet and 10 feet, b) said vehicle having overall with between 3½ feet and 5 feet, c) at least one nozzle carried on the vehicle, d) at least one tank carried by the vehicle to supply fire abating pressurized fluid including pressurized foam to the nozzle, said at least one tank located at a relatively low level on the vehicle, said method including e) propelling and maneuvering said relatively small vehicle across terrain to an area where a fire exists, f) delivering fluid from said tank to said nozzle, in pressurized condition, g) and maneuvering said nozzle to direct fluid into the fire, h) providing and operating controls to control said fluid delivery, i) and independently sliding said at least one tank, and said controls, outwardly from the vehicle, for inspection and repair.

28. The method of claim 27 including periodically replenishing fluid into the tank.

29. The method of claim 27 wherein multiple of said vehicles are provided, each being separately propelled, maneuvered and operated to deliver fluid into the fire at a selected location.

30. The method of claim 29 including providing a fluid source or sources at a selected distance from the fire, and returning said vehicles to said source or sources for replenishing fluid into the vehicle tanks, as needed, for subsequent use of the vehicle in fighting the fire.

31. The method of claim 30 wherein said source or sources are provided as a tank or tanks on a carrier vehicle.

32. The method of claim 31 wherein said carrier vehicle is configured to also carry certain of said fire-fighting vehicles, to be off-loaded in the vicinity of a fire.

33. The method of claim 29 including providing means at each vehicle for selecting delivery of i) a spray in cone form ii) mist droplets less than 1,000 Å in diameter iii) a narrow stream of fluid.

34. The method of claim 27 including providing a carrier vehicle for certain of said fire-fighting vehicles, to be transported to the vicinity of a fire, and off-loaded to travel over terrain into proximity of the fire.

* * * * *